US006102245A

United States Patent [19]

Haberman

[11] Patent Number: 6,102,245

[45] **Date of Patent: *Aug. 15, 2000**

[54] DRINKING VESSEL WITH VALVE

[76] Inventor: Mandy Nicola Haberman, Dove Cottage, 44 Watford Road, Radlett, Herts WD7 8LR, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,673

[22] Filed: Oct. 18, 1996

Related U.S. Application Data

[63] Continuation of application No. 08/318,707, filed as application No. PCT/GB93/00728, Apr. 7, 1993, abandoned.

[30] Foreign Application Priority Data

Apr. 7, 1992 [GB] United Kingdom ..... 9207766

[51] Int. Cl.[7] ..... A47G 19/22

[52] U.S. Cl. ..... 220/714; 215/387; 220/710.5; 220/713; 220/717; 222/559; 222/561

[58] Field of Search ..... 215/11.1, 11.4, 215/11.5, 387; 220/703, 705, 710.5, 711, 713, 714, 717, 203.01, 203.11, 203.18, 203.19, 203.29, 89.1; 222/528, 529, 559, 561

[56] References Cited

U.S. PATENT DOCUMENTS

| | | | |
|---|---|---|---|
| 4,138 | 8/1845 | Pratt . | |
| 2,174,361 | 9/1939 | Condon | 215/11.5 |
| 2,544,464 | 3/1951 | Matthews et al. | 215/11.5 |
| 2,569,139 | 9/1951 | Abelson | 215/11.5 X |
| 2,608,841 | 9/1952 | Rice | 215/11.5 X |

(List continued on next page.)

FOREIGN PATENT DOCUMENTS

| | | |
|---|---|---|
| 0160336 | 11/1985 | European Pat. Off. . |
| 0278125 | 8/1988 | European Pat. Off. . |
| 0 326 743 A2 | 8/1989 | European Pat. Off. . |
| 382 631 A1 | 2/1990 | European Pat. Off. . |
| 384 394 A2 | 2/1990 | European Pat. Off. . |
| 0395380 | 10/1990 | European Pat. Off. . |
| 0555623 | 8/1993 | European Pat. Off. . |
| 996998 | 12/1951 | France . |
| 1364891 | 10/1964 | France . |
| 2128875 | 12/1972 | Germany . |
| 2609310 | 9/1976 | Germany . |
| 31 18976 A1 | 12/1982 | Germany . |
| 3941668 A1 | 4/1991 | Germany . |
| 145824 | 2/1961 | Russian Federation . |
| 1046518 | 10/1966 | United Kingdom . |
| 1253398 | 11/1971 | United Kingdom . |
| 2015350 | 9/1979 | United Kingdom . |
| 2098958 | 12/1982 | United Kingdom . |
| 2131301 | 6/1984 | United Kingdom . |
| 2 169 210 | 7/1986 | United Kingdom . |
| 2226014 | 6/1990 | United Kingdom . |
| 2266045 | 10/1993 | United Kingdom . |
| 2279130 | 12/1994 | United Kingdom . |
| WO 93/19718 | 10/1993 | WIPO . |

OTHER PUBLICATIONS

"Purfect Ideas from Tommee Tippee," Chemist & Druggist, Aug. 15, 1992.

Judgement rendered Jan. 15, 1999 in *Haberman v. Jackel International Ltd.* by the Honorable Mr. Justice Laddie, High Court of Justice, Chancery Division, Patents Court, United Kingdom.

*Primary Examiner*—Stephen K. Cronin
*Assistant Examiner*—Robin A. Hylton
*Attorney, Agent, or Firm*—Wallenstein & Wagner, Ltd.

[57] ABSTRACT

A drinking vessel suitable for use as a trainer cup or the like comprises an open-mouthed generally cup-shaped container (2) and a lid (5) for the open mouth of the container. The lid has a mouthpiece (7) associated with it. Valve means (18) are provided to prevent flow of liquid from the interior of the container through the mouthpiece unless a predetermined level of suction is applied to the mouthpiece. Suction alone may be sufficient to withdraw liquid from the trainer cup.

16 Claims, 5 Drawing Sheets

U.S. PATENT DOCUMENTS

| | | | |
|---|---|---|---|
| 2,628,616 | 2/1953 | Ransom | 215/11.5 |
| 2,796,062 | 6/1957 | Tupper | 215/11.6 |
| 2,989,961 | 6/1961 | Blanchett | 215/11.4 |
| 3,139,064 | 6/1964 | Harle . | |
| 3,393,817 | 7/1968 | Meierhoefer | 215/11.5 |
| 3,424,157 | 1/1969 | Paolo | 215/11.4 |
| 3,650,271 | 3/1972 | Pelli . | |
| 4,245,752 | 1/1981 | Prueher | 220/714 X |
| 4,303,170 | 12/1981 | Panicci | 220/713 X |
| 4,921,112 | 5/1990 | Juhlin et al. | 215/11.4 |
| 4,946,062 | 8/1990 | Coy | 220/714 |
| 4,953,737 | 9/1990 | Meyers | 215/387 X |
| 5,072,842 | 12/1991 | White | 215/11.4 |
| 5,079,013 | 1/1992 | Belanger . | |
| 5,101,991 | 4/1992 | Morifuji et al. | 215/11.5 X |
| 5,186,347 | 2/1993 | Freeman et al. . | |
| 5,213,236 | 5/1993 | Brown et al. | 220/89.1 X |

DRINKING VESSEL WITH VALVE

This is a continuation of application Ser. No. 08/318,707, filed on Dec. 7, 1994, now abandoned which is a 371 of PCT/GB93/00728 filed Apr. 7, 1993.

This invention relates to drinking vessels and more particularly to drinking vessels suitable for use as a trainer cup or the like.

Trainer cups (that is a cup or mug provided with a lid having a mouthpiece—usually a spout—associated therewith) are well known and have been designed to bridge the gap between use of a baby's feeding bottle and use of a normal cup or glass by a young child. Such a trainer cup will often be a child's first step in learning to feed itself. As this period in a child's development will usually coincide with the cutting of its first teeth, quite apart from the child's inherent difficulty in handling what is new to it which may lead to the cup inadvertently being knocked over, the irritability characteristic of teething allied with the natural exuberance of young children tends to exacerbate what is frequently a noisy and messy experience.

The existence of the lid may reduce or at least delay the effect of knocking the cup over, but will not deter a child from shaking the cup violently up and down. Neither will the lid delay spillage for very long if the cup is knocked over. Notwithstanding that trainer cups of this kind have been known for a very lengthy period of time, I am unaware of any practical arrangement for overcoming these self-evident problems.

In the somewhat different field of babies feeding bottles, I have myself designed arrangements in which a valve interrupts the flow of fluid from the interior of the bottle through a teat or other mouthpiece (see for example my U.S. Pat. Nos. 2,131,301 and 2,169,210). Bottles to my design have achieved some commercial success particularly in the rather specialised field of feeding of babies with sucking problems. Other arrangements proposing valved feeding bottles such as U.S. Pat. Nos. 4,135,513, 3,704,803 and 4,339,046 and UK Patents 460 274 and 1 253 398 have been proposed in the patent literature but I am not aware that any of these proposals have proved of practical utility. I am not aware of any of them having been marketed. Nevertheless, it is clear that there have been a series of proposals by different workers for the valving of babies feeding bottles. Notwithstanding this, I am not aware of any previous proposal for valving training cups or the like. As will become clear from the detailed description hereinbelow of a presently preferred embodiment of training cup or the like constructed in accordance with my present invention, the present invention enables the production of practical embodiments of trainer cups which neatly and effectively overcome the problems of accidental spillage or of child-generated deliberate attempts at spilling the contents of the trainer cup. Moreover, my practical embodiment achieves this desirable end, never previously achieved, so far as I am aware, in a simple, neat construction which is cheap and simple to manufacture and facilitates easy cleaning. It has no moving parts.

According to a first aspect of my invention, I provide a drinking vessel suitable for use as a trainer cup or the like, comprising: an open-mouthed generally cup-shaped container; and a lid for the open mouth of said cup-shaped container, the lid having a mouthpiece associated therewith; the vessel being provided with valve means adapted to prevent flow of liquid from the interior of the container through the mouthpiece unless a predetermined level of suction is applied to the mouthpiece, the arrangement being such that a user is enabled to draw liquid through the mouthpiece by the sole application of suction thereto.

The valve may be a separate valve member located in use between the container and the lid. Alternatively the valve may be integrally formed with the lid.

Suitably the lid is apertured to allow for the ingress of air to make up for the liquid sucked via the valve through the mouthpiece. To prevent the possibility of liquid issuing through this aperture, that is also suitably provided with a valve, preferably a non-return valve allowing flow of air from the exterior into the container but preventing flow of liquid from the interior of the container outwardly through the aperture.

Conveniently the two valves are provided by a single valve member which may be attached to the lid. The valve member may comprise a single piece of latex, silicone rubber, plastics or other suitable flexible material integrally moulded with two valves, one adapted to underlie the lid in the region of the mouthpiece and the other underlying the aperture. The two valves may comprise dome-shaped regions, the larger underlying the lid in the region of the mouthpiece and being concave towards the interior of the container, and the smaller underlying the aperture and being convex towards the interior. These dome-shaped regions are provided with a simple slit or cross-cut which in effect is self-closing, in each case the slit or cross-cut allowing flow from the concave to the convex side but not in the reverse direction. Other valve formations (e.g., a so-called "duck-bill" or a flap valve) are feasible. The valve member may be held in place between the lid and a valve member support plate.

In an alternative arrangement in which the valve is integrally formed with the lid, the lid itself may be made of a material listed above as a candidate for the separate valve member. The exit valve may comprise several dome-shaped regions, each with a slit or cross-cut, at the extreme end of the mouthpiece. Alternatively the extreme end of the mouthpiece may be flat and provided with a slit or cross-cut. The inlet valve may comprise a dome-shaped region convex towards the interior of the container with a slit or cross-cut exactly as described above for the separate valve member.

The lid may also have an inner ring spaced from the skirt to provide a channel in which the rim of the container fits to more firmly secure the lid onto the container.

In a further alternative arrangement, the mouthpiece and the valve member are integrally formed and the lid is provided with at least one aperture to allow the mouthpiece to be pushed up through the lid. The mouthpiece/valve member may be of latex, silicone rubber, plastics or other suitable flexible material. The lid may have a second smaller aperture to allow the ingress of air and this aperture is also suitably valved. The exit valve of the mouthpiece may be a slit valve. Alternatively, the second aperture is provided on the mouthpiece. The mouthpiece has a straight-sided portion so that a child sucking on the mouthpiece will not interfere with the ingress of air through this aperture. The aperture may be valved, the valve comprising a dome-shaped region convex towards the interior of the container/mouthpiece having a slit or cross cut.

According to a second and alternative aspect of my invention, I provide a drinking vessel suitable for use as a trainer cup or the like, comprising: an open-mouthed generally cup-shaped container; and a lid for the open-mouth of said cup-shaped container, the lid having an aperture therethrough and a separate mouthpiece formed of a flexible material, and having a circumextending flange, mounted at said aperture so that a distal portion thereof protrudes outwardly of said lid, the extreme end of said mouthpiece being provided with valve means adapted to prevent flow of liquid from the interior of the container through the mouthpiece unless a predetermined level of suction is applied to the mouthpiece, the arrangement being such that a user is enabled to draw liquid through the mouthpiece by the sole application of suction thereto.

As will be appreciated, not only young children may have a feeding problem with liquids. The term "trainer cup or the like" is accordingly intended herein to encompass cups having the features identified, whether intended for use by a young child or alternatively, for example, by the infirm or senile.

The invention is hereinafter more particularly described by way of example only with reference to the accompanying drawings in which.

Figure 1:
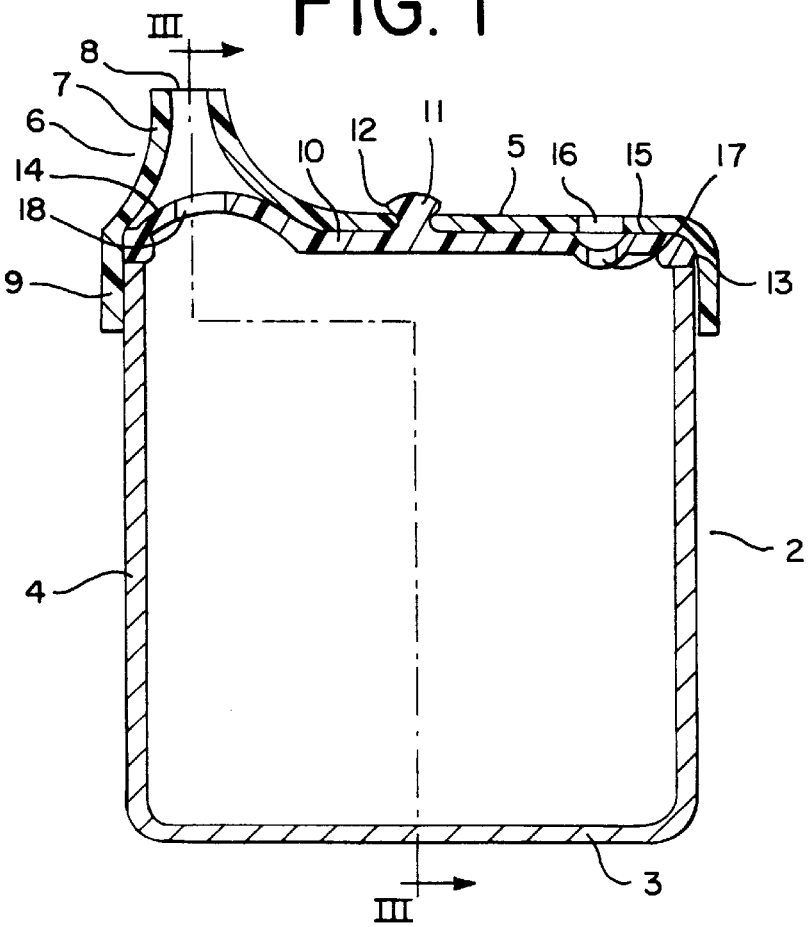
FIG. 1 is a sectional view through an embodiment of trainer cup or the like constructed in accordance with the present invention.
Figure 2:
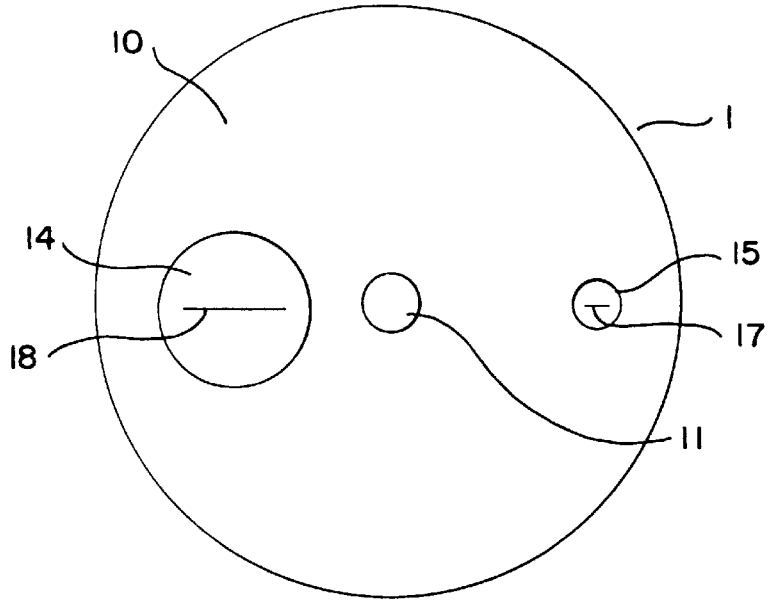
FIG. 2 is a plan view of the valve assembly of the trainer cup of FIG. 1.
Figure 3:
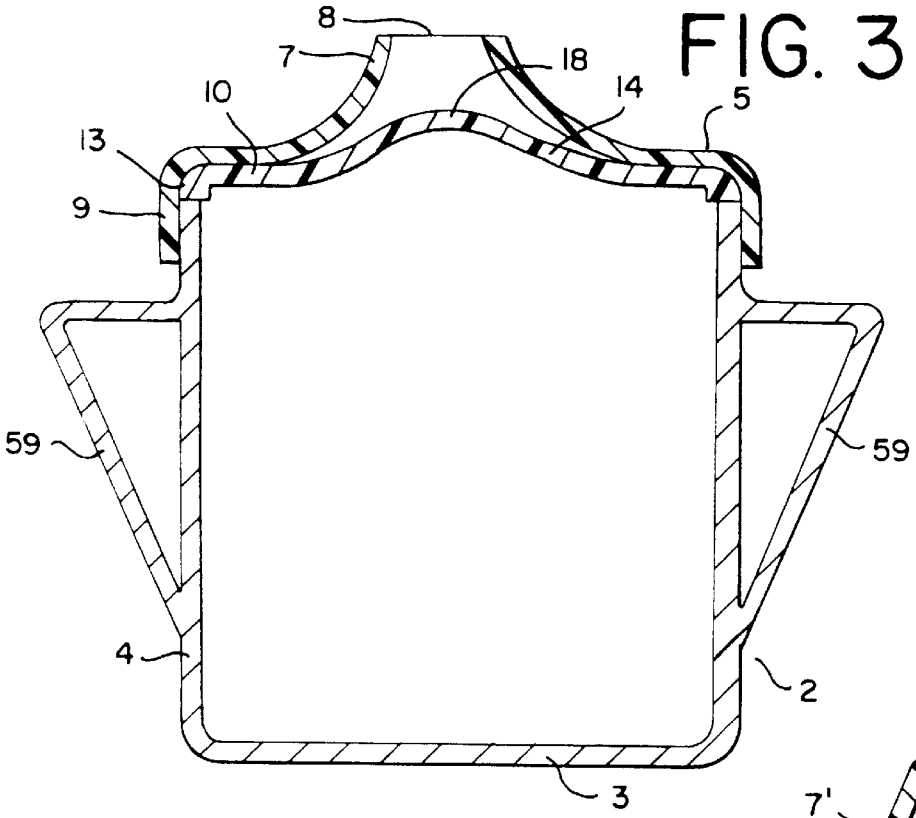
FIG. 3 is a sectional view taken along the line III—III in FIG. 1.
Figure 4:
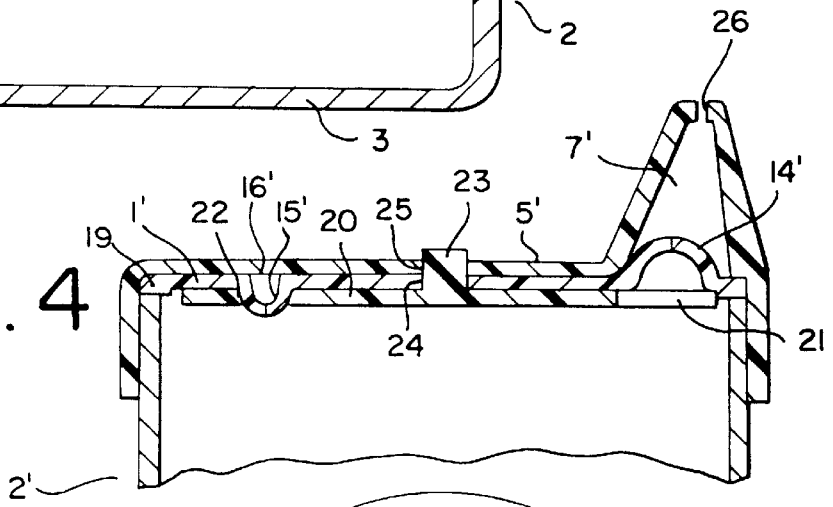
FIG. 4 is a sectional view through an alternative embodiment of trainer cup or the like also constructed in accordance with the present invention.
Figure 5:
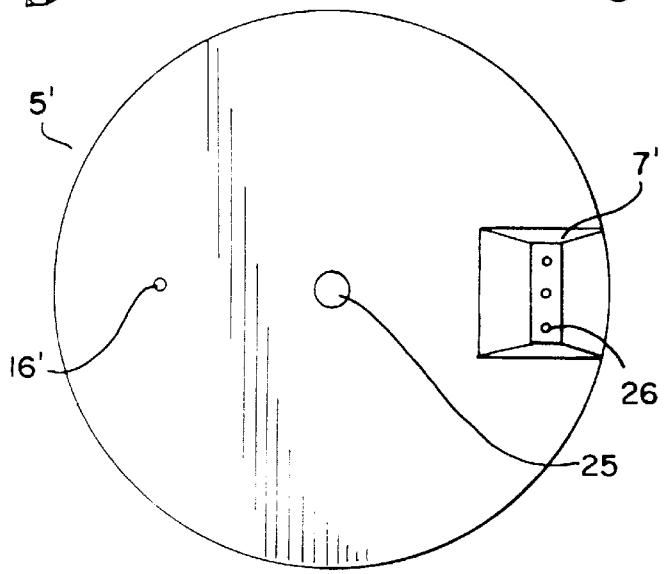
FIG. 5 is a plan view of the lid of the trainer cup of FIG. 4.
Figure 8:
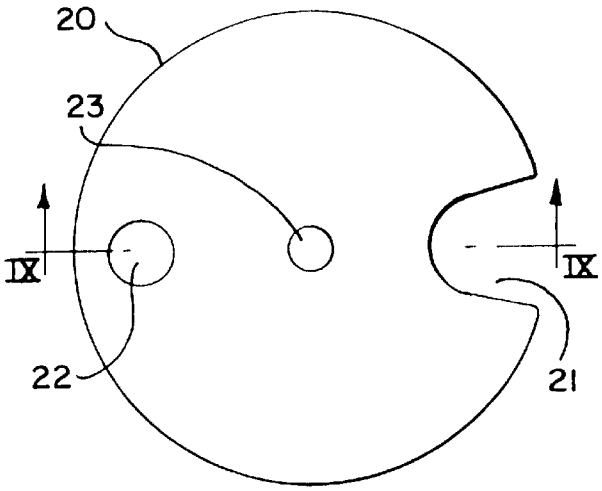
FIG. 8 is a plan view of a valve member support plate of the trainer cup of FIG. 4.
Figure 9:
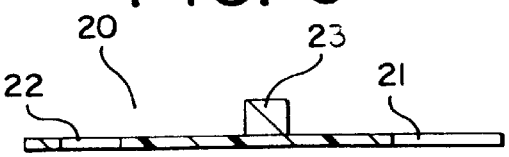
FIG. 9 is a sectional view taken along the line IX—IX in FIG. 8.
Figure 6:
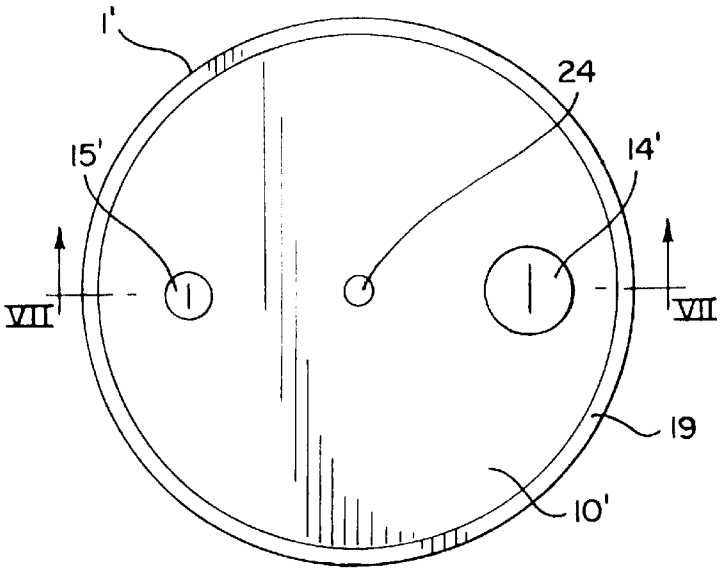
FIG. 6 is a plan view of the valve assembly of the trainer cup of FIG. 4.
Figure 7:
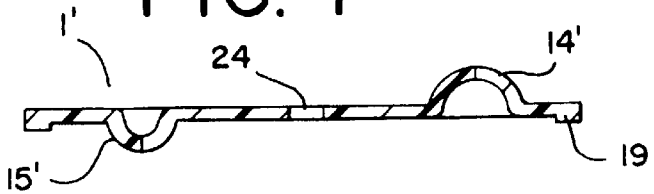
FIG. 7 is a sectional view taken along the line VII—VII in FIG. 6.

The trainer cup illustrated in FIGS. 1 and 3 is, apart from the addition of the valve assembly 1 described in more detail hereinbelow and illustrated in FIG. 2, generally conventional. It comprises a generally cup-shaped container 2 having a bottom 3 and an upstanding cylindrical wall 4 terminating in an open mouth. Across the open mouth is a lid generally indicated 5. The lid 5 has a mouthpiece 6 associated with it. In this case the mouthpiece comprises a spout 7 integrally formed with the lid and having an opening 8. FIGS. 4 and 5 show an alternative spout 7' which has a number of small openings 26. Other arrangements are feasible. In particular, a tube or straw could be received in a gland provided in the lid. The lid 5 includes a skirt 9 the internal diameter of which is just slightly less than the external diameter of the container so that the skirt 9 forms a tight fit with the container when the lid is fitted over the open mouth.

Valve assembly 1 is located in use between the container 2 and the lid 5 and, as will be explained below, serves to prevent flow of liquid from the interior of the container 2 through the spout 7 of mouthpiece 6 unless suction is applied at the opening 8 to the spout. As can best be seen from FIGS. 1 and 2, the valve assembly comprises a generally disc-shaped member 10 which is suitably moulded from latex, silicone rubber, or other suitable plastics material. Member 10 is fitted to the lid 5 by means of a central boss 11 which is received in a corresponding opening 12 in the centre of the lid. In an alternative arrangement, the boss may be integrally formed with the lid, and the valve assembly 1 is provided with a central opening for receiving the boss on the lid. Although member 10 may be permanently fitted to the lid, for ease in cleaning, the member is suitably detachable from the lid by removal of boss 11 from opening 12. Around its periphery 13 the valve assembly disc member 10 is provided with an integral lip or thickened region in the form of a ring. This not only provides for strength at the edge but provides a region which, since the disc is given a diameter greater than the interior diameter of the lid results in compression at the edge so that the valve assembly disc member provides a sealing effect around its periphery in effect between the lid and the container serving to additionally reduce the likelihood of spillage by leakage between the container and its lid. The disc 10 is provided with two dome-shaped regions 14 and 15. The larger of these is positioned to underlie the mouthpiece 6 and to be concave towards the interior of the container in use. The smaller of the two dome-shaped regions has the opposite configuration and is provided for a purpose to be explained below. Each dome-shaped region is provided with a slit or cross-cut partially thereacross.

Lid 2 is apertured at 16 to provide for ingress of air into the container as liquid is sucked out through the spout 7 of mouthpiece 6. The smaller dome 15 underlies aperture 16 in use and allows flow of air from the exterior through the slit 17 and into the interior of the container, but only when the pressure within the container is sub-atmospheric through suction applied to mouthpiece 6. The slit is in effect a self-closing non-return valve so that liquid within the container is prevented from exit via the slit and aperture 16. Slit 18 in the larger dome 14 is also self-closing. In other words, unless suction is applied to the opening 8 of spout 7, liquid within the container will not pass through the slit. Consequently, if a container with liquid therewithin is simply shaken up and down or is accidentally spilt, firstly, fluid cannot pass through slit 17 and aperture 16 and secondly, cannot pass through slit 18 into the mouthpiece. The sealing at the periphery tends additionally to prevent the possibility of leakage between the lid and the container.

In alternative arrangements the disc 10 is provide with different shapes of valve, e.g., the dome-shaped regions 14 and 15 may be replaced by duck-bill valves or by a simple flap valve. These valve assemblies should all operate in a manner similar to the arrangement previously described.

The trainer cup illustrated in FIG. 4 is similar to that illustrated in FIG. 1, comprising cup-shaped container 2', valve assembly 1' and lid 5'. The valve assembly 1' is shown with the thickened lip 19 forming a sealing ring. Additionally, the trainer cup is provided with a valve member support plate 20, which underlies the valve assembly 1'. It is provided with openings 21 and 22 corresponding to the dome-shaped regions 14' and 15' of the valve assembly 1'. The plate 20 has a central boss 23 which passes through an opening 24 of the valve assembly 1' and an opening 25 of the lid 5'.

Valve assembly 1' and lid 5' are assembled as before. The plate 20 holds valve assembly 1' against the lid and is attached to the lid by means of boss 23 being fitted through openings 24 and 25. The valves are unimpaired by retainer 20, opening 21 underlying the larger dome-shaped region 14' and opening 22 underlying the smaller dome-shaped region 15'.

Figure 10:
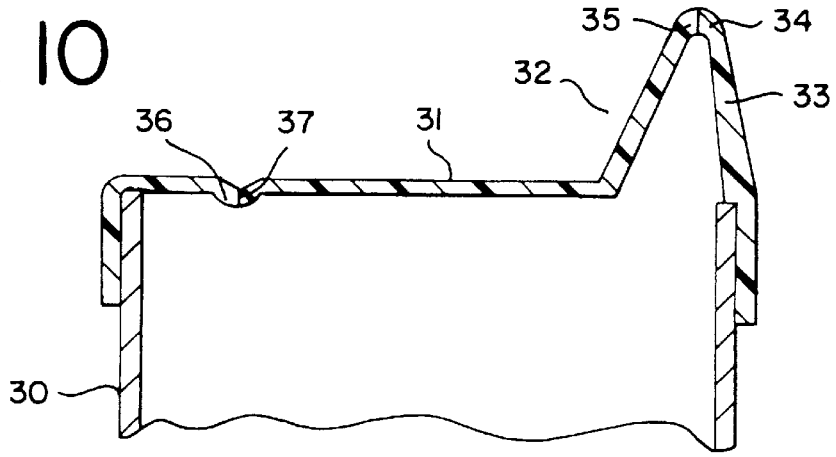
FIG. 10 is a sectional view through a further alternative embodiment of trainer cup or the like also constructed in accordance with the present invention.

FIG. 10 illustrates an alternative arrangement in which the valve assembly is integrally formed with the lid. A cup-shaped container 30 has a lid 31. Lid 31 is provided with a mouthpiece 32 in the form of a spout 33. The spout is integrally formed with a number of dome-shaped regions 34 concave toward the interior of the container in use, and each provided with a slit or cross-cut 35. In an alternative arrangement the extreme end of the mouthpiece may be flat and provided with a slit or cross-cut. The lid is integrally formed with a further dome-shaped region 36, of the opposite configuration to dome-shaped region 34, and also provided with a slit or cross-cut 37. In use lip pressure and suction applied at the spout 33 opens the slits 35 allowing flow of liquid out of the container. Slit 37 also opens allowing ingress of air in to the container. The slits again have the effect of being self-closing non-return valves. The lid 31 with integrally formed valve assembly may be moulded from similar materials to those used for moulding the valve assembly 1.

Figure 12:
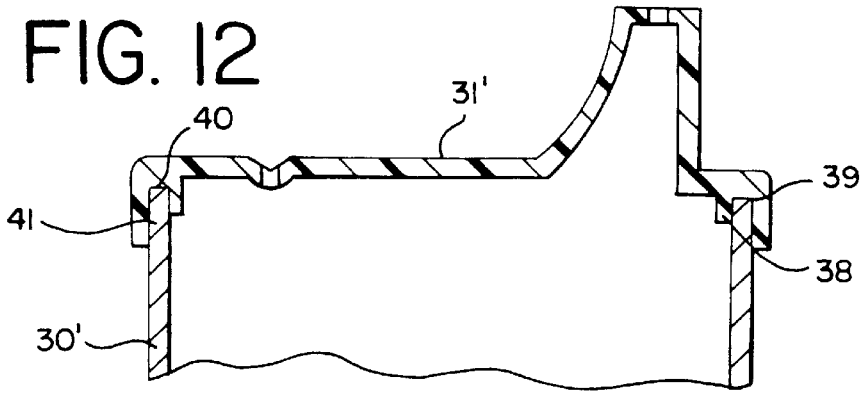
FIG. 12 is a sectional view through a further alternative embodiment of trainer cup constructed in accordance with the present invention.

FIG. 12 illustrates a similar arrangement to that of FIG. 10 but with the additional feature of a ring 38 inwards of the skirt 39 of the lid 31'. This ring 38 together with the skirt 39 forms a groove 40 into which the rim 41 of container 30' fits, to provide a tighter seal.

Figure 13:
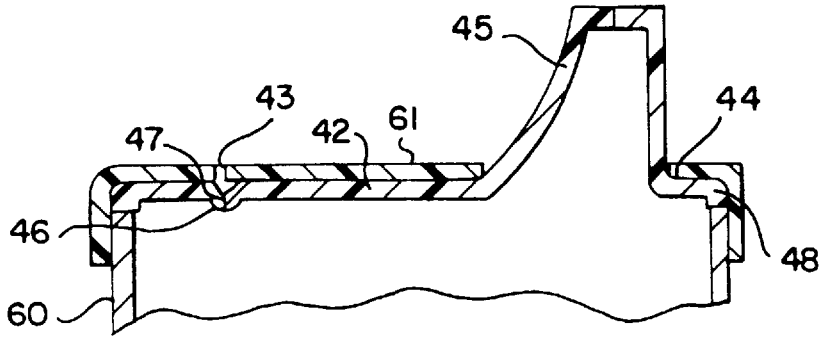
FIG. 13 is a sectional view through a yet further alternative embodiment of trainer cup constructed in accordance with the present invention.
Figure 14:
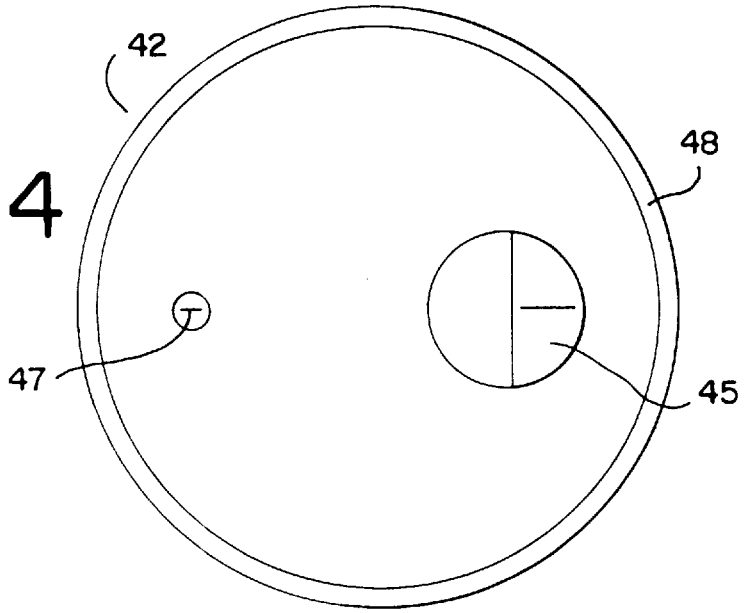
FIG. 14 is a plan view of the valve and mouthpiece assembly of the trainer cup of FIG. 13.

In the alternative arrangement of FIG. 13, container 60 is provided with lid 61 and a combined mouthpiece and valve member 42. Lid 61 is provided with two apertures 43 and 44. Aperture 43 allows for the ingress of air while aperture 44 is large enough to allow the mouthpiece 45 to fit within this aperture. A slit valve is provided on the mouthpiece. Valve means 46 comprising a dome-shaped region provided with a slit or cross-cut 47 underlies the aperture 43. The rim 48 of the member 42 is thickened to provide a good seal.

Figure 15:
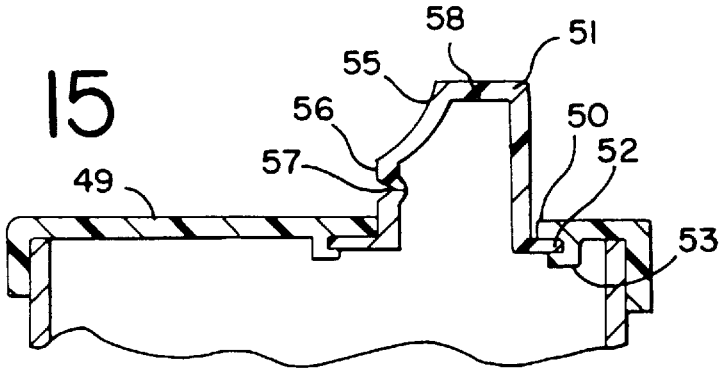
FIG. 15 is a sectional view through a further alternative embodiment of trainer cup also constructed in accordance with the present invention.

In a further alternative arrangement illustrated schematically in FIG. 15, lid 49 is also provided with aperture 50, large enough to accommodate mouthpiece 51. The mouthpiece 51 in this case is formed from flexible material, for example, latex or silicone rubber and has a flange 52, and so has a configuration corresponding to that of a conventional feeding bottle teat. Flange 52 may be press-fitted over disc 53 of lid 49 prior to attaching the lid 49 to container 54. Mouthpiece 51 comprises a spout portion 55 and a straight sided section 56. Straight sided section 56 is provided with valve means 57 in the form of a dome-shaped region convex towards the container and provided with a slit to allow for the ingress of air into the container 54 as fluid is sucked out through spout region 55. Spout 55 is provided with a slit valve 58 which controls flow from the trainer cup. The application of suction alone to the mouthpiece is sufficient to open the otherwise closed slit valve 58 to allow liquid from the trainer cup. In the absence of suction liquid is effectively prevented from leaving the cup. The teat-configuration mouthpiece of this embodiment may be readily replaceable.

I have found in practice that although practical embodiments of a trainer cup according to my design are very effective in preventing deliberate or accidental spillage in this fashion, they have no significant effect in reducing the ability of a child to drink from the cup by sucking on the spout. I have also found that cups to my design can readily be employed by the relatively infirm or by the senile. With this view, the container is provided with a pair of opposed handles 59 which can readily be grasped by a young child or by an arthritic aged person.

Figure 11:
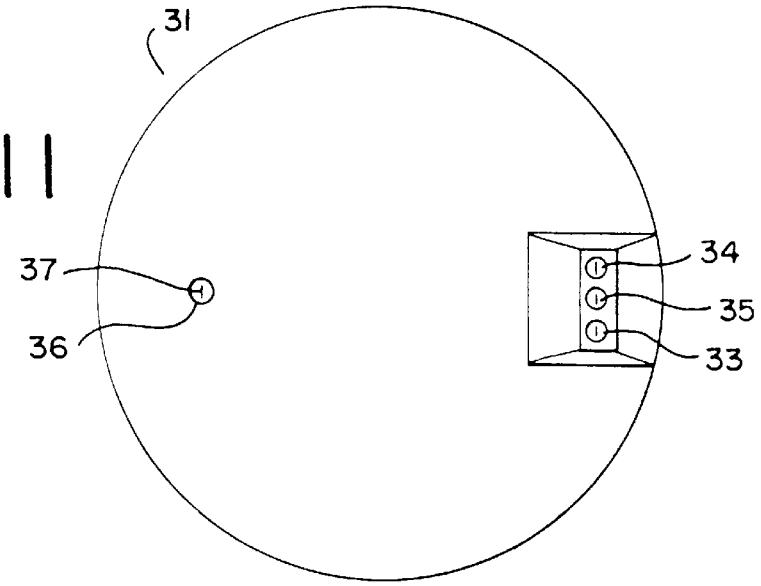
FIG. 11 is a plan view of the lid of the trainer cup of FIG. 10.

As compared with conventional trainer cups, the only additional expense in cups to my design is the additional cost of the valve assembly 1, and optionally the valve assembly support plate, or alternatively the substitution of the one-piece lid and valve assembly of FIG. 11 for a conventional trainer cup lid. As the valve assembly or one-piece lid and valve assembly would be simple one-piece mouldings, the additional cost is negligible. Assembly is simple since, e.g. the boss 11 in the FIG. 1 embodiment simply needs to be pushed into opening 12. Cups to my design are accordingly cheap and simple to manufacture and are adapted for ready use by ordinary members of the public or, for example, in a children's home or an old people's home, being easy to clean as the parts are readily separable.

I claim:

1. A drinking vessel for use as a trainer cup comprising:

a cup-shaped container for drink, said container having an open mouth;

a lid covering said open mouth of said container, said lid including a substantially planar cover portion and a skirt surrounding said cover portion for engaging said container, said lid forming a tight fit over said open mouth, said lid being further provided with a spout extending from said cover portion; and a valve element operatively associated with said spout, said valve element having a substantially dome-shaped region, said valve element comprising a self-closing slit valve formed in said dome-shaped region, said slit valve being arranged to open upon no more than a predetermined difference of pressure, greater within the vessel than outside, being present across said slit valve, whereby said valve element is effective to prevent flow of said drink from within said container unless a predetermined level of suction is applied to the spout, and whereby a user is able to draw said drink through the spout by the sole application of suction thereto to provide said difference of pressure.

2. The drinking vessel of claim 1 wherein said valve element comprises a separate valve member positioned between said lid and said container.

3. The drinking vessel of claim 1 wherein said planar cover portion of said lid comprises an air inlet aperture on an upper surface thereof, and a second valve element in operative association therewith, said second valve element being arranged to allow air into said container and to prevent flow of said drink outward from said container.

4. The drinking vessel of claim 2 wherein:

said cover portion of said lid comprises an air inlet aperture, and said separate valve member includes a second valve element therethrough, said second valve element being operatively associated with said air inlet aperture, said second valve element being arranged to allow air into said container through said air inlet aperture and to prevent flow of said drink outward from said container through said air inlet aperture.

5. A drinking vessel for use as a trainer cup, comprising:

a cup-shaped container for drink, said container having an open mouth;

a lid covering said open mouth of said container, said lid including a substantially planar cover portion and a skirt surrounding said cover portion for engaging said container, said lid forming a tight fit over said open mouth, said lid being further provided with a spout extending from said cover portion; and a valve means in said lid operatively associated with said spout, said valve means having a substantially dome-shaped region, a slit serving as a self-closing slit valve being formed in said dome-shaped region, whereby said valve means is effective to prevent flow of said drink from within said container unless a predetermined level of suction is applied to the spout creating a pressure differential greater within the vessel than outside the vessel, and whereby a user is able to draw said drink through the spout by the sole application of suction thereto to provide said difference of pressure.

6. The drinking vessel of claim 5, wherein said valve means comprises a separate valve member positioned between said lid and said container.

7. The drinking vessel of claim 6, wherein said cover portion of said lid comprises an air inlet aperture, and said separate valve member includes a second valve therethrough, said second valve being operatively associated with said air inlet aperture, said second valve allowing air into said container through said air inlet aperture and preventing flow of drink outward from said container through said air inlet aperture.

8. The drinking vessel of claim 7, wherein said second valve means has a dome-shaped region, a slit serving as a self-closing slit valve being formed in said dome-shaped region, said dome-shaped region of said second valve means being concave in the opposite sense to the dome-shaped region associated with the first mentioned valve means.

9. The drinking vessel of claim 6, wherein said cover portion of said lid comprises an air inlet aperture, and said separate valve member includes a second valve therethrough, said second valve being operatively associated with said air inlet aperture, said second valve allowing air into said container through said air inlet aperture and preventing flow of drink outward from said container through said air inlet aperture.

10. The drinking vessel of claim 9, wherein said separate valve member comprises two dome-shaped regions, the first dome-shaped region being concave in one direction and having said slit serving as said self-closing slit valve formed therein, and the second dome-shaped region being concave in a direction opposite to said one direction and having a self-closing slit serving as said second valve formed therein.

11. The drinking vessel of claim 5 wherein said cover portion of said lid further comprises an air inlet aperture and a second valve means arranged to allow air into said container through said air inlet aperture and prevent flow of drink outward from said air inlet aperture.

12. A drinking vessel for use as a trainer cup, comprising:

a cup-shaped container for drink, said container having an open mouth;

a lid covering said open mouth of said container, said lid including a substantially planar cover portion and a skirt surrounding said cover portion for engaging said container, said lid forming a tight fit over said open mouth, said lid being further provided with a spout extending front said cover portion; and a valve means operatively associated with said spout, said valve means comprising a separate valve member positioned between said lid and said container, said valve member having a self-closing slit valve therethrough, said self-closing slit valve being arranged to open upon no more than a predetermined difference of pressure, greater within the vessel than outside, being present across said slit valve, whereby said valve means is effective to prevent flow of said drink from within said container unless a predetermined level of suction is applied to the spout, and whereby a user is enabled to draw said drink through the spout by the sole application of suction thereto to provide said difference of pressure.

13. The drinking vessel of claim 12, wherein said cover portion of said lid comprises an air inlet aperture, and said separate valve member includes a second valve means therethrough, said second valve means being associated with said air inlet aperture, said second valve means being arranged to allow air into said container through said air inlet aperture and to prevent flow of drink outward from said container through said air inlet aperture.

14. The drinking vessel of claim 1 wherein the valve element is removably connected to the lid.

15. A drinking vessel, comprising:

a cup-shaped container for drink, said container having an open mouth;

a lid covering said open mouth of said container and engaging said container, said lid including a substantially planar cover portion, said lid further comprising a spout extending from said cover portion; and a valve being in said lid and associated with said spout, said valve having a substantially dome-shaped region and said valve element having a self-closing slit valve formed in said dome-shaped region, said slit valve opening upon a predetermined level of suction applied to the spout creating pressure differential greater within the vessel than outside the vessel, whereby said valve is effective to prevent flow of said drink from within said container unless a predetermined level of suction is applied to the spout, and whereby a user is able to draw said drink through the spout by the sole application of suction thereto to provide said pressure differential.

16. The drinking vessel of claim 15 wherein said cover portion of said lid comprises an air inlet aperture having a second valve in association therewith, said second valve allowing air into said container and preventing flow of said drink outward from said container.

* * * * *

UNITED STATES PATENT AND TRADEMARK OFFICE

CERTIFICATE OF CORRECTION

PATENT NO. : 6,102,245
DATED : August 15, 2000
INVENTOR(S) : Mandy Nicola Haberman It is certified that error appears in the above-identified patent and that said Letters Patent is hereby corrected as shown below:

Col. 8, Line 3, delete the word "front" and insert therefor --from--

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*